United States Patent [19]

Picoy et al.

[11] 3,946,891

[45] Mar. 30, 1976

[54] SAFETY CAP FOR PRESSURIZED BOTTLES

[76] Inventors: Anthony R. Picoy, 15340 Lemac St., Van Nuys, Calif. 91406; Osvaldo Santos, Ing. Gillermo Marconi 2470 Olivos PC1A, Buenos Aires, Argentina

[22] Filed: Apr. 7, 1975

[21] Appl. No.: 565,627

[52] U.S. Cl. ..... 215/256; 215/277; 215/320; 215/321

[51] Int. Cl.[2] ..... B65D 41/48

[58] Field of Search ..... 215/256, 254, 253, 320, 215/321

[56] References Cited

UNITED STATES PATENTS

| | | | |
|---|---|---|---|
| 797,377 | 8/1905 | Schroeder | 215/277 |
| 2,806,620 | 9/1957 | Blanch | 215/256 X |
| 2,814,404 | 11/1957 | Towns | 215/320 |
| 2,947,432 | 8/1960 | Marcel | 215/320 X |
| 3,032,226 | 5/1962 | Terwilliger | 215/256 |
| 3,820,678 | 6/1974 | Zipper | 215/253 |

FOREIGN PATENTS OR APPLICATIONS

| | | | |
|---|---|---|---|
| 662,500 | 12/1951 | United Kingdom | 215/321 |

*Primary Examiner*—Donald F. Norton
*Attorney, Agent, or Firm*—Robert M. Ashen; Robert J. Schaap

[57] ABSTRACT

A flexible plastic safety cap for bottles containing pressurized liquid such as champagne or sparkling burgundy. This cap is designed for bottles having a neck open at the top and with an external downwardly facing shoulder. The cap includes an inner sealing portion which goes into the opening of the neck and an outer locking portion which includes a flexible, resilient tubular section that surrounds the neck. The tubular section includes two or more internal rib portions which engage the neck shoulder to lock the cap to the bottle neck. The tubular section may also include an integral pull tab portion for readily releasing and removing the cap from the bottle.

10 Claims, 5 Drawing Figures

SAFETY CAP FOR PRESSURIZED BOTTLES

Classically, bottles for such pressurized liquids as champagne or sparkling burgundy have been sealed with cork caps which were locked in place by a wire retainer. To prevent the wire from cutting into the cork, an intermediate metal disc would be interposed between the cork and the wire. Several disadvantages are presented by such a cap construction. A substantial amount of labor is involved to properly place the cork, the intermediate disc and the wire retainer. Further, the integrity of the cork material may not always be sufficient to effectively seal the wine from spoilage.

With the development of plastic materials, some effort has been made to replace the cork and wire retainer with a plastic cap. However, because of the smooth surfaces provided by the bottle itself and a generally smooth and low friction surface provided by most plastic materials which are sufficiently impervious to provide the necessary seal for the bottle, the need for a safety lock such as the wire retainer has not been eliminated.

Thus, there is a need in the industry for a relatively simple safety cap for pressurized bottles which is inexpensive and convenient to manufacture, as well as to install.

The safety cap of the present invention contemplates a safety cap arrangement for pressurized bottles containing pressurized liquid such as champagne or sparkling burgundy which is relatively simple and economical to manufacture and assemble onto the bottle. This cap is designed for use with a bottle having a neck portion open at its upper end and with an external downwardly facing annular shoulder extending around the neck portion. The cap includes an inner sealing portion which goes into the opening of the neck of the bottle and an outer locking portion comprising a flexible plastic outer tubular section which surrounds the neck. The tubular section has two or more internal lip portions which engage the neck shoulder to thereby lock the cap in the bottle neck. The tubular section may also include an integral pull tab portion for readily releasing and removing the cap from the bottle.

Figure 1:
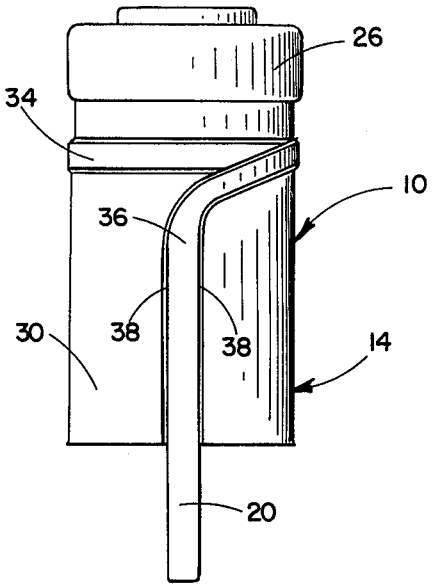
FIG. 1 is a side elevational view of a presently preferred embodiment of the safety cap of the present invention.
Figure 2:
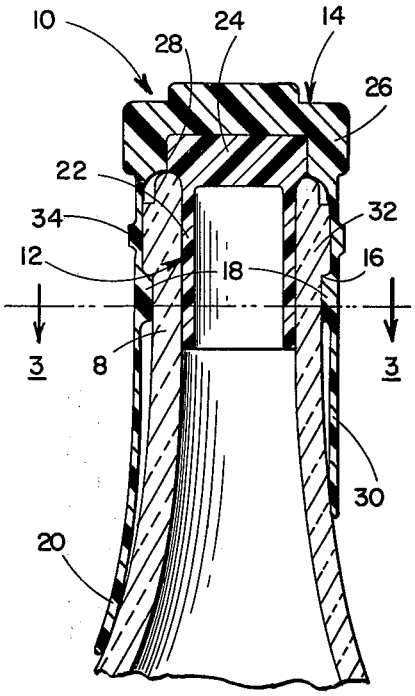
FIG. 2 is a side sectional view showing the cap of FIG. 1 installed in the neck of a bottle.
Figure 3:
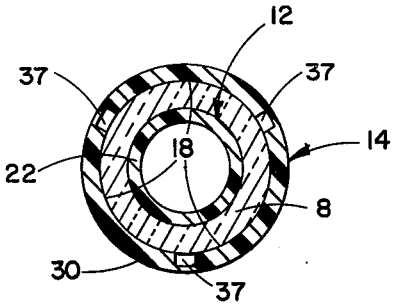
FIG. 3 is a sectional view taken generally along line 3—3 of FIG. 2.

The presently preferred embodiment of this invention is illustrated in FIGS. 1 – 3. The cap 10 comprises generally an inner sealing portion 12 which is received in the open upper end of the neck 8 of the bottle to be sealed, and an outer locking portion 14 which surrounds the upper end of the bottle neck and engages portions of the neck to lock the inner sealing portion of the cap in place and to prevent it from being dislodged by the internal pressure exerted on it from the contents of the bottle. As shown in FIG. 2, the illustrated inner sealing portion 12 is a separate piece from the outer locking portion 14. The bottle neck 8 is opened at its upper end and the inner sealing portion 12 is received therein. Around the outside of the bottle neck spaced downwardly from its open upper end, an annular band 32 is formed. The band has a generally cylindrical outer surface and its lower end provides a downwardly facing annular shoulder 16. The outer locking portion 14 comprises a tubular section 30 of flexible, resilient plastic material. Tubular section 30 includes two or more internal rib portions 18 (see FIG. 3) for engaging in locking engagement the shoulder 16 when the cap 10 is in sealing and locking engagement with the bottle as shown in FIG. 2. The tubular section 30 may also include an integral pull tab portion 20 for readily releasing and removing the cap from the bottle.

Now considering the embodiment of FIGS. 1 – 3 in further detail, the illustrated inner sealing portion comprises a tubular lower sealing section 22 configured and proportioned to be received in a tight pressed fit within the opening at the upper end of the neck 8 of the bottle as shown in FIG. 2. The sealing portion 12 further includes an upper or enlarged head section 24 which may be integrally formed with the lower section 22. Head section 24 is larger than the opening in the bottle neck to define and limit the insertion of the inner sealing section 22 of the cap 12 into the bottle. This inner sealing portion 12 may be made of a suitable material such as polypropylene.

The illustrated outer locking portion 14 comprises an upper cap section 26 having a downwardly facing internal cavity 28 proportioned to receive snuggly therein the head section 24 of the inner sealing portion 12. The outer sealing portion 14 further includes the integrally formed tubular section 30 which extends downwardly from the cap section 26 and surrounds the neck of the bottle to be sealed. The illustrated bottle neck includes the annular exterior rib or band 32, the lower edge of which defines the annular shoulder 16. As noted above, the shoulder 16 faces generally downwardly and in the opposite direction from the open upper end of the bottle. The rib portions 18 are shown integrally formed around the interior of the tubular section 30. The rib portions 18 are positioned so that when the cap is assembled as shown in FIG. 2, the rib portions will engage the shoulder 16 to thereby tightly hold the inner sealing portion 12 in place in the neck of the bottle. The sealing portion 14 may be made of a suitable flexible, resilient material such as polyethylene or polypropylene so that it may be simply and effectively installed on the bottle by forcing it down over the neck to the locked position. In this connection, the tubular lower section 30 should be sufficiently expandable to permit the rib portions 18 to fit down over the enlarged external band 32 of the bottle neck. The portion 30 should be sufficiently tough and resilient enough, however, to draw the rib portions 18 back inwardly once they have passed the band 32 to form a good locking engagement with the annular shoulder 16, and thereby provide the desired lock for the cap. Thus, the assembly of the cap requires merely a simple press-on operation, as distinguished from the much more time consuming and complicated operations required to install a wire over a cork or cap in the bottle.

The integral pull tab portion 20 provides an easy and convenient means for readily releasing and removing the cap from the bottle. The pull tab portion 20 is shown integrally formed with the tubular section 30. Portion 20 includes an annular ring portion 34 extending around the tubular section 30 above the rib portions 18. As shown in FIG. 1, the ring portion 34 merges into a tab portion 36 which curves downwardly and then extends down below the lower end of the tubular section 30 so that its lower end can be grasped and pulled by the user. The pull tab portion 20 may be thicker than the remainder of the tubular section 30 and/or it may be joined to the tubular section 30 by sections or areas of reduced thickness as indicated by numbers 38 in FIG. 1. By pulling on the free end of the pull tab portion 20, it may be separated from the adjacent portions of the tubular section 30, first in the area of the tab portion 36 and then in the area of the annular ring portion 34. This serves to release the rib portions 18 from the shoulder 16 and permits simple removal of the remainder of the locking portion 14. The inner sealing portion 12 may then be removed by conventional means from the bottle to provide access to the contents of the bottle.

It will be noted that the illustrated rib portions 18 are each approximately one-third of the circumference around the bottle neck, and that the three rib portions 18 are separated from each other by small cut-out or notched areas 37 as shown in FIG. 3. The use of multiple rib portions is an important feature of the present invention. By comparison, a single ring portion extending completely around the circumference of the bottle neck would tend to resist expansion when it is forced over the exterior band 32 of the bottle neck. Further, once so expanded, it may less readily contract so that it may not then form a sufficiently tight and dependable lock for the bottle. In other words, the multiple rib portions 18 provide a better and more dependable lock for the cap. While three rib portions are illustrated, it would also be possible to utilize two rib portions or four or more rib portions if so desired.

Figure 4:
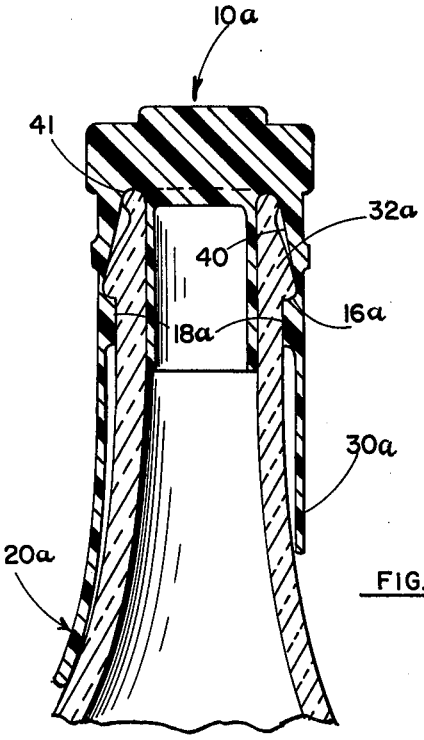
FIG. 4 is a side sectional view of the top end of a bottle showing a modified form of safety cap.

FIG. 4 illustrates a modified form of safety cap designed primarily for use with a champagne-type bottle. As shown in FIG. 4, the annular external band 32*a* around the upper end of the bottle neck does not have a generally cylindrical upright surface as does the band 32 shown in FIG. 2. The band 32*a* rather has a generally frusto-conical outer surface which is smallest at the top and curves outwardly to its largest diameter at its lower end. This band 32*a* forms a downwardly facing annular shoulder 16*a*, generally comparable to the shoulder 16 shown in FIG. 2. The cap 10*a* is generally similar in construction to cap 10 in FIGS. 1–3, but with certain differences which will now be described. The tubular section 30*a* surrounding the bottle neck provides rib portions 18*a* generally comparable to the rib portions 18 of cap 10, however, the interior of the tubular section 30*a* above the rib portions 18*a* has a generally frusto-conical configuration as distinguished from the generally cylindrical interior configuration of the upper part of the tubular section 30 of cap 10. This frusto-conical interior surface 40 of the cap 10*a* is largest at its lower end where it engages the largest portion of the annular bottle band 32*a*, and it then progressively reduces in diameter to its upper end where it may engage the lip 41 of the open end of the bottle. In addition to the provision of frusto-conical inclined surface 40, the cap 10*a* is formed as an integral unit with the inner sealing portion and the outer locking portion combined in a single molded plastic part. The unitary part would be cheaper to install as it would require only a single instead of a two-step installation as in the case of cap 10. On the other hand, this unitary construction would probably be more expensive to mold. In other respects the cap 10*a* would generally be like cap 10, including a pull tab portion 20*a* for readily releasing and removing the cap.

Figure 5:
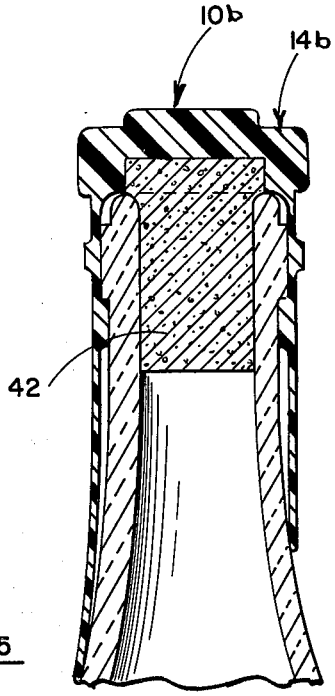
FIG. 5 is a side sectional view of the top end of a bottle showing a further modified form of safety cap.

FIG. 5 shows a further modified form of safety cap 10*b*. The outer locking portion 14*b* of cap 10*b* is essentially identical to the outer locking portion 14 of cap 10. The inner sealing portion 12 of cap 10 has been replaced in the embodiment of FIG. 5 by a solid cork 42. This latter arrangement may be desirable where the winery or bottler desires to use a genuine cork stopper while also desiring a simple and inexpensive way of locking the cork stopper in place, as well as providing for its ready and easy release.

What is claimed is:

1. Safety cap structure for a bottle having pressurized contents, the bottle having a generally tubular neck open at its upper end and having an annular exterior shoulder facing away from the open end, said cap structure comprising:

an inner sealing portion for being received in the neck of the bottle to form a seal therewith;

an outer locking portion including a generally tubular flexible resilient section for being disposed, when the sealing portion is in the bottle neck opening, around the outside of the bottle neck, and extending at least as far from the open end of the bottle as the external shoulder;

means integrally formed inside of the tubular section defining X circumferentially separated rib portions that extend radially inwardly for engagement with the external shoulder of the bottle neck, X being at least two, each of said rib portions having opposed ends and being separated by a small notch at each of its ends from an end of an adjacent rib portion such that each rib portion is in close proximity at either of its ends to an end of an adjacent rib portion, each of said notches extending a small distance around the circumference of the tubular section relative to the distance which each rib portion extends around said circumference, each rib portion extending approximately Y degrees around the inside of the tubular section Y being equal to 360° divided by X; and means on the tubular section defining a pull tab portion integrally formed with but separable from the remainder of the tubular section for being pulled to thereby release the rib portions from their engagement with the annular shoulder of the bottle neck.

2. The safety cap structure of claim 1 wherein said rib portion defining means define a generally continuous annular rib having at least two interruptions therein.

3. The safety cap structure of claim 2 wherein there are at least three of said rib portions.

4. The safety cap structure of claim 1 wherein said inner sealing portion and said outer locking portion are separate pieces.

5. The safety cap structure of claim 1 wherein said inner sealing portion in said outer locking portion are integrally formed as a single piece.

6. The safety cap structure of claim 1 wherein the bottle neck is a generally cylindrical exterior section above the annular external shoulder and wherein the tubular section of the cap has a mating cylindrical interior section above the rib portions.

7. The safety cap structure of claim 1 wherein the bottle neck is a generally arcuate curved section above the annular external shoulder and the tubular section of the cap has a mating arcuate curved interior section above the rib portions.

8. The combination comprising:

a. a bottle for holding pressurized contents, the bottle having a generally tubular neck open at its upper end and having an annular external shoulder facing away from the open end; and b. a cap structure comprising:

an inner sealing portion received in the neck of the bottle to form a seal therewith;

an outer locking portion including a generally tubular flexible resilient section disposed around the outside of the bottle neck, and extending at least as far from the open end of the bottle as the external shoulder;

means integrally formed inside of the tubular section defining X circumferentially separated rib portions that extend radially inwardly and are in engagement with the external shoulder of the bottle neck, X being at least two, and no more than three, each of said rib portions having opposed ends and being separated by a small space at each of its ends from an end of an adjacent rib portion such that each rib portion is in close proximity at either of its ends to an end of an adjacent rib portion, each rib portion extending approximately Y-degrees around the inside of the tubular section, Y being equal to 360° divided by X; and means on the tubular section defining a pull tab portion integrally formed with but separable from the remainder of the tubular section to thereby release the rib portions from their engagement with the annular shoulder of the bottle neck.

9. A safety cap structure for a bottle having pressurized contents such as champagne or sparkling burgundy, the bottle having a generally tubular neck open at its upper end and having an external band adjacent to its open upper end, an annular external shoulder being defined around the lower edge of the exterior band, the shoulder facing away from the open end of the bottle neck, said cap structure comprising:

an inner sealing portion of plastic material including an enlarged head section larger in cross section than the opening in the bottle neck and a lower tubular section integrally formed with and depending from the head section for tight sealing fit within the open neck of the bottle to form a seal therewith;

an outer locking portion of plastic material including an upper cap section having an interior cavity proportioned to receive therein the head section of the inner sealing portion, said outer locking portion further including a generally tubular flexible resilient plastic section integrally formed with the cap section for being disposed, when the sealing portion is in the bottle neck opening, around the outside of the bottle neck, said tubular locking section extending below said external shoulder of the bottle neck;

means integrally formed inside of the tubular locking section defining three circumferentially separated rib portions that extend radially inwardly for engagement, when the cap structure is installed on the bottle, with the external shoulder of the bottle neck, said means which define the rib portions defining a generally continuous annular rib structure interrupted by a small notch at three generally equal locations therearound, each of said rib portions extending approximately 120° around the circumference of said locking section; and means integrally formed on the tubular locking section defining a pull tab portion separable from the remainder of the tubular locking section to thereby release said rib portions from their engagement with the annular shoulder of the bottle neck to facilitate ready removal of the cap structure from the bottle.

10. A plastic locking structure for a bottle having pressurized contents, the bottle having a generally tubular neck open at its upper end and having an annular exterior shoulder facing away from the open end, a sealing member being received in the neck of the bottle to form a seal therewith, said locking structure comprising:

a plastic outer locking portion including a generally tubular flexible resilient section for being disposed, when the sealing member is in the bottle neck opening, around the outside of the bottle neck, and extending at least as far from the open end of the bottle as the external shoulder;

means integrally formed inside of the tubular section defining X circumferentially separated rib portions that extend radially inwardly for engagement with the external shoulder of the bottle neck, X being at least two, each of said rib portions having opposed ends and being separated by a small notch at each of its ends from an end of an adjacent rib portion such that each rib portion is in close proximity at either of its ends to an end of an adjacent rib portion, each rib portion extending approximately Y degrees around the inside of the tubular section, Y being equal to 360° divided by X; and means on the tubular section defining a pull tab portion integrally formed with but separable from the remainder of the tubular section to thereby release the rib portions from their engagement with the annular shoulder of the bottle neck.

* * * * *